US007966743B2

(12) United States Patent
Piatt et al.

(10) Patent No.: US 7,966,743 B2
(45) Date of Patent: Jun. 28, 2011

(54) MICRO-STRUCTURED DRYING FOR INKJET PRINTERS

(75) Inventors: Michael J. Piatt, Dayton, OH (US); Kenneth E. Hix, Englewood, OH (US); Daniel Gelbart, Vancouver (CA)

(73) Assignee: Eastman Kodak Company, Rochester, NY (US)

( * ) Notice: Subject to any disclaimer, the term of this patent is extended or adjusted under 35 U.S.C. 154(b) by 526 days.

(21) Appl. No.: 11/831,110

(22) Filed: Jul. 31, 2007

(65) Prior Publication Data

US 2009/0031579 A1 Feb. 5, 2009

(51) Int. Cl.
*F26B 21/06* (2006.01)

(52) U.S. Cl. ..... 34/82; 34/617; 34/623; 34/632; 34/634; 34/649; 347/43; 347/67; 264/210.5; 264/235.6; 55/486; 55/528; 451/36; 451/59; 118/715; 118/719

(58) Field of Classification Search ..... 34/82, 617, 34/623, 632, 634, 649; 347/43, 67; 451/36, 451/59; 55/486, 528; 264/210.5, 235; 118/715, 118/719
See application file for complete search history.

(56) References Cited

U.S. PATENT DOCUMENTS

| | | | | | |
|---|---|---|---|---|---|
| 2,696,055 | A | * | 12/1954 | Murphey | 34/645 |
| 2,704,896 | A | * | 3/1955 | Hopkins | 34/76 |
| 2,741,217 | A | * | 4/1956 | Speed et al. | 118/643 |
| 2,920,399 | A | * | 1/1960 | Fry, Jr. | 34/647 |
| 2,994,134 | A | * | 8/1961 | Adams | 34/145 |
| 3,125,424 | A | * | 3/1964 | Peck | 34/629 |
| 3,324,570 | A | | 6/1967 | Flaith et al. | |
| 3,353,544 | A | * | 11/1967 | Fordyce et al. | 131/342 |
| 3,383,239 | A | * | 5/1968 | Christman, Jr. | 427/542 |
| 3,429,057 | A | * | 2/1969 | Thygeson, Sr. | 34/656 |
| 3,457,336 | A | * | 7/1969 | Harris | 264/14 |
| 3,489,555 | A | * | 1/1970 | Phillips et al. | 419/40 |
| 3,708,965 | A | * | 1/1973 | Domnick | 55/488 |
| 3,720,002 | A | | 3/1973 | Martin | |
| 3,744,963 | A | * | 7/1973 | Flynn | 432/59 |
| 3,955,287 | A | * | 5/1976 | Brock et al. | 34/636 |
| 4,093,147 | A | * | 6/1978 | Bromley et al. | 242/159 |
| 4,120,583 | A | * | 10/1978 | Hyatt | 355/86 |
| 4,123,492 | A | * | 10/1978 | McNamara et al. | 264/210.5 |
| 4,195,418 | A | * | 4/1980 | Sturgeon et al. | 34/216 |
| 4,200,994 | A | * | 5/1980 | Mellor | 34/646 |
| 4,228,120 | A | * | 10/1980 | Bromley et al. | 264/235.6 |
| 4,231,768 | A | * | 11/1980 | Seibert et al. | 96/128 |

(Continued)

FOREIGN PATENT DOCUMENTS

DE 3526453 A1 * 1/1987

(Continued)

*Primary Examiner* — Stephen M. Gravini
(74) *Attorney, Agent, or Firm* — William R. Zimmerli

(57) ABSTRACT

A dryer operable in close proximity to and in series with an inkjet printhead comprises a heat source and an air bearing structure on one side of the predetermined path and having a pressurized air inlet and an air outlet adjacent to the drying position of the receiver medium. Air flow from the air bearing structure outlet forms an air bearing for the receiver medium. A microporous filter positioned at the outlet and being adapted to convert the air flow from the outlet to a diffuse flow, the microporous filter being formed of an inner layer of very fine screen for optimum air diffusion and an outer layer of courser woven screen to add rigidity and protection from scuffing.

15 Claims, 6 Drawing Sheets

U.S. PATENT DOCUMENTS

| | | | | | |
|---|---|---|---|---|---|
| 4,250,741 | A | * | 2/1981 | Scriven et al. | 73/64.48 |
| 4,301,102 | A | * | 11/1981 | Fernstrom et al. | 264/151 |
| 4,343,860 | A | * | 8/1982 | Fernstrom et al. | 428/371 |
| 4,435,909 | A | * | 3/1984 | Williamson, Jr. | 34/82 |
| 4,445,776 | A | * | 5/1984 | Hyatt | 355/78 |
| 4,486,870 | A | * | 12/1984 | Pettigrew et al. | 369/30.04 |
| 4,538,361 | A | * | 9/1985 | Gresens | 34/82 |
| 4,594,796 | A | * | 6/1986 | Gierse et al. | 34/82 |
| 4,615,124 | A | * | 10/1986 | Gierse et al. | 34/82 |
| 4,621,440 | A | * | 11/1986 | Gierse et al. | 34/638 |
| 4,818,257 | A | | 4/1989 | Kennedy et al. | |
| 4,819,341 | A | * | 4/1989 | Gayso | 34/86 |
| 5,092,059 | A | | 3/1992 | Wimberger et al. | |
| 5,145,298 | A | * | 9/1992 | Marantette | 409/135 |
| 5,210,959 | A | * | 5/1993 | Brestovansky et al. | 34/629 |
| 5,242,289 | A | * | 9/1993 | Forgash et al. | 425/71 |
| 5,244,482 | A | * | 9/1993 | Hassenboehler et al. | 55/528 |
| 5,261,166 | A | | 11/1993 | Seeley et al. | |
| 5,270,733 | A | * | 12/1993 | Parsons et al. | 347/215 |
| 5,293,699 | A | | 3/1994 | Faust et al. | |
| 5,384,969 | A | * | 1/1995 | Troetscher et al. | 34/82 |
| 5,396,716 | A | * | 3/1995 | Smart et al. | 34/464 |
| 5,423,260 | A | | 6/1995 | Goldberg et al. | |
| 5,441,550 | A | * | 8/1995 | Hassenboehler et al. | 55/486 |
| 5,443,606 | A | * | 8/1995 | Hassenboehler et al. | 55/486 |
| 5,486,411 | A | * | 1/1996 | Hassenboehler et al. | 442/328 |
| RE35,206 | E | * | 4/1996 | Hassenboehler et al. | 55/528 |
| 5,536,158 | A | * | 7/1996 | Dresie et al. | 425/75 |
| 5,599,366 | A | * | 2/1997 | Hassenboehler et al. | 55/486 |
| 5,606,640 | A | * | 2/1997 | Murphy | 392/382 |
| 5,621,983 | A | * | 4/1997 | Lundemann et al. | 34/641 |
| 5,631,685 | A | | 5/1997 | Gooray et al. | |
| 5,654,799 | A | * | 8/1997 | Chase et al. | 356/600 |
| 5,730,923 | A | * | 3/1998 | Hassenboehler et al. | 264/479 |
| 5,747,394 | A | * | 5/1998 | Hassenboehler et al. | 442/328 |
| 5,771,984 | A | * | 6/1998 | Potter et al. | 175/14 |
| 5,781,202 | A | * | 7/1998 | Silverbrook | 347/3 |
| 5,781,205 | A | * | 7/1998 | Silverbrook | 347/17 |
| 5,784,077 | A | * | 7/1998 | Silverbrook | 347/2 |
| 5,796,416 | A | * | 8/1998 | Silverbrook | 347/47 |
| 5,796,418 | A | * | 8/1998 | Silverbrook | 347/55 |
| 5,797,290 | A | * | 8/1998 | Blissell et al. | 72/53 |
| 5,801,739 | A | * | 9/1998 | Silverbrook | 347/106 |
| 5,805,178 | A | * | 9/1998 | Silverbrook | 347/15 |
| 5,808,631 | A | * | 9/1998 | Silverbrook | 347/9 |
| 5,808,639 | A | * | 9/1998 | Silverbrook | 347/57 |
| 5,812,162 | A | * | 9/1998 | Silverbrook | 347/58 |
| 5,815,178 | A | * | 9/1998 | Silverbrook | 347/55 |
| 5,815,179 | A | * | 9/1998 | Silverbrook | 347/59 |
| 5,838,339 | A | * | 11/1998 | Silverbrook | 347/9 |
| 5,841,449 | A | * | 11/1998 | Silverbrook | 347/55 |
| 5,850,241 | A | * | 12/1998 | Silverbrook | 347/54 |
| 5,853,962 | A | * | 12/1998 | Bowers | 430/331 |
| 5,854,431 | A | * | 12/1998 | Linker et al. | 73/863.23 |
| 5,856,836 | A | * | 1/1999 | Silverbrook | 347/55 |
| 5,859,652 | A | * | 1/1999 | Silverbrook | 347/2 |
| 5,864,351 | A | * | 1/1999 | Silverbrook | 347/57 |
| 5,870,124 | A | * | 2/1999 | Silverbrook | 347/85 |
| 5,871,656 | A | * | 2/1999 | Silverbrook | 216/27 |
| 5,880,759 | A | * | 3/1999 | Silverbrook | 347/55 |
| 5,881,476 | A | * | 3/1999 | Strobush et al. | 34/451 |
| 5,892,524 | A | * | 4/1999 | Silverbrook | 347/15 |
| 5,905,517 | A | * | 5/1999 | Silverbrook | 347/61 |
| 5,909,227 | A | * | 6/1999 | Silverbrook | 347/3 |
| 5,914,737 | A | * | 6/1999 | Silverbrook | 347/48 |
| 5,916,358 | A | * | 6/1999 | Bagchi et al. | 106/31.59 |
| 5,920,331 | A | * | 7/1999 | Silverbrook | 347/60 |
| 5,930,915 | A | * | 8/1999 | Dhaemers | 34/511 |
| 6,002,847 | A | * | 12/1999 | Silverbrook | 358/1.17 |
| 6,012,799 | A | * | 1/2000 | Silverbrook | 347/43 |
| 6,018,886 | A | * | 2/2000 | Bell et al. | 34/380 |
| 6,030,072 | A | * | 2/2000 | Silverbrook | 347/67 |
| 6,030,906 | A | * | 2/2000 | Hassenboehler et al. | 442/328 |
| 6,041,516 | A | * | 3/2000 | Preszler et al. | 34/392 |
| 6,050,138 | A | * | 4/2000 | Lynch et al. | 73/150 A |
| 6,058,621 | A | | 5/2000 | Piccinino, Jr. et al. | |
| 6,073,368 | A | * | 6/2000 | Freiberg | 34/633 |
| 6,085,601 | A | * | 7/2000 | Linker et al. | 73/863.12 |
| 6,088,930 | A | | 7/2000 | Robin et al. | |
| 6,102,777 | A | * | 8/2000 | Duescher et al. | 451/36 |
| 6,126,846 | A | * | 10/2000 | Silverbrook | 216/27 |
| 6,134,806 | A | * | 10/2000 | Dhaemers | 34/404 |
| 6,149,506 | A | * | 11/2000 | Duescher | 451/59 |
| 6,217,155 | B1 | * | 4/2001 | Silverbrook | 347/56 |
| 6,238,467 | B1 | * | 5/2001 | Azarian et al. | 96/135 |
| 6,321,594 | B1 | * | 11/2001 | Brown et al. | 73/150 A |
| 6,327,994 | B1 | * | 12/2001 | Labrador | 114/382 |
| 6,349,588 | B1 | * | 2/2002 | Brown et al. | 73/37 |
| 6,412,190 | B1 | | 7/2002 | Smith | |
| 6,428,160 | B2 | | 8/2002 | Roy et al. | |
| 6,463,674 | B1 | * | 10/2002 | Meyers et al. | 34/304 |
| 6,514,559 | B1 | * | 2/2003 | Miyamoto et al. | 427/78 |
| 6,564,473 | B2 | * | 5/2003 | Aydore | 34/504 |
| 6,690,473 | B1 | * | 2/2004 | Stanke et al. | 356/601 |
| 6,701,637 | B2 | * | 3/2004 | Lindsay et al. | 34/71 |
| 6,716,629 | B2 | * | 4/2004 | Hess et al. | 435/420 |
| 6,756,751 | B2 | * | 6/2004 | Hunter | 318/135 |
| 6,769,969 | B1 | * | 8/2004 | Duescher | 451/59 |
| 6,785,982 | B2 | * | 9/2004 | Yonkoski et al. | 34/463 |
| 6,796,123 | B2 | * | 9/2004 | Lasker | 60/520 |
| 6,822,407 | B2 | * | 11/2004 | Hunter | 318/135 |
| 6,829,054 | B2 | * | 12/2004 | Stanke et al. | 356/601 |
| 6,840,068 | B2 | * | 1/2005 | Pasin et al. | 68/5 C |
| 6,861,614 | B1 | * | 3/2005 | Tanabe et al. | 219/121.66 |
| RE38,797 | E | * | 9/2005 | Linker et al. | 73/863.12 |
| 6,992,290 | B2 | * | 1/2006 | Watanabe et al. | 250/310 |
| 7,032,324 | B2 | * | 4/2006 | Kolb et al. | 34/451 |
| 7,100,302 | B2 | * | 9/2006 | Kolb et al. | 34/209 |
| 7,172,982 | B2 | * | 2/2007 | Jaglowski et al. | 442/76 |
| 7,196,042 | B2 | * | 3/2007 | Nakatani et al. | 508/391 |
| 7,251,017 | B2 | * | 7/2007 | Novak et al. | 355/53 |
| 7,271,888 | B2 | * | 9/2007 | Frodis et al. | 356/237.1 |
| 7,312,418 | B2 | * | 12/2007 | Tanabe et al. | 219/121.65 |
| 7,345,742 | B2 | * | 3/2008 | Novak et al. | 355/72 |
| 7,351,969 | B2 | * | 4/2008 | Watanabe et al. | 250/310 |
| 7,442,405 | B2 | * | 10/2008 | Miyamoto et al. | 427/77 |
| 7,469,638 | B2 | * | 12/2008 | MacPherson et al. | 101/483 |
| 7,520,800 | B2 | * | 4/2009 | Duescher | 451/527 |
| 7,569,838 | B2 | * | 8/2009 | Watanabe et al. | 250/428 |
| 7,588,674 | B2 | * | 9/2009 | Frodis et al. | 205/222 |
| 7,632,434 | B2 | * | 12/2009 | Duescher | 264/12 |
| 7,638,915 | B2 | * | 12/2009 | Sentmanat | 310/156.11 |
| 7,695,752 | B2 | * | 4/2010 | Bonner et al. | 427/2.13 |
| 7,762,052 | B2 | * | 7/2010 | Dunning et al. | 56/344 |
| 2002/0088940 | A1 | * | 7/2002 | Watanabe et al. | 250/310 |
| 2002/0094533 | A1 | * | 7/2002 | Hess et al. | 435/6 |
| 2002/0171815 | A1 | * | 11/2002 | Matsuyama et al. | 355/55 |
| 2003/0026893 | A1 | * | 2/2003 | Miyamoto et al. | 427/58 |
| 2003/0074805 | A1 | * | 4/2003 | Aydore | 34/444 |
| 2003/0124716 | A1 | * | 7/2003 | Hess et al. | 435/287.1 |
| 2003/0156270 | A1 | * | 8/2003 | Hunter | 355/72 |
| 2003/0180807 | A1 | * | 9/2003 | Hess et al. | 435/7.1 |
| 2003/0226276 | A1 | * | 12/2003 | Yonkoski et al. | 34/380 |
| 2004/0046850 | A1 | | 3/2004 | Domoto et al. | |
| 2004/0080757 | A1 | * | 4/2004 | Stanke et al. | 356/601 |
| 2004/0083731 | A1 | * | 5/2004 | Lasker | 60/645 |
| 2004/0109054 | A1 | | 6/2004 | Martin et al. | |
| 2004/0126544 | A1 | * | 7/2004 | Jaglowski et al. | 428/196 |
| 2004/0173144 | A1 | * | 9/2004 | Edwards et al. | 118/300 |
| 2004/0186025 | A1 | * | 9/2004 | Nakatani et al. | 508/130 |
| 2004/0211285 | A1 | * | 10/2004 | Hunter | 74/490.08 |
| 2004/0213897 | A1 | * | 10/2004 | Miyamoto et al. | 427/58 |
| 2004/0231593 | A1 | * | 11/2004 | Edwards et al. | 118/719 |
| 2004/0231594 | A1 | * | 11/2004 | Edwards et al. | 118/719 |
| 2004/0235406 | A1 | * | 11/2004 | Duescher | 451/527 |
| 2005/0016451 | A1 | * | 1/2005 | Edwards et al. | 118/715 |
| 2005/0032469 | A1 | * | 2/2005 | Duescher | 451/548 |
| 2005/0109743 | A1 | * | 5/2005 | Tanabe et al. | 219/121.73 |
| 2005/0118939 | A1 | * | 6/2005 | Duescher | 451/527 |
| 2005/0126171 | A1 | * | 6/2005 | Lasker | 60/645 |
| 2005/0142846 | A1 | * | 6/2005 | Frodis et al. | 438/622 |
| 2005/0181316 | A1 | * | 8/2005 | Frodis et al. | 430/455 |
| 2005/0221996 | A1 | * | 10/2005 | Nakatani et al. | 508/130 |
| 2005/0221997 | A1 | * | 10/2005 | Nakatani et al. | 508/137 |
| 2005/0221999 | A1 | * | 10/2005 | Nakatani et al. | 508/480 |
| 2006/0023182 | A1 | * | 2/2006 | Novak et al. | 355/53 |
| 2006/0118719 | A1 | * | 6/2006 | Watanabe et al. | 250/310 |

2006/0144276 A1* 7/2006 MacPherson et al. ..... 101/485
2006/0172278 A1* 8/2006 Bonner et al. ..... 435/4
2006/0277714 A1* 12/2006 Dunning et al. ..... 15/405
2006/0283539 A1* 12/2006 Slafer ..... 156/230
2007/0031308 A1* 2/2007 Cotter ..... 422/211
2007/0139631 A1* 6/2007 Novak et al. ..... 355/53
2007/0166945 A1* 7/2007 Tanabe et al. ..... 438/401
2007/0252961 A1* 11/2007 Novak et al. ..... 355/30
2007/0252962 A1* 11/2007 Novak et al. ..... 355/30
2007/0258062 A1* 11/2007 Novak et al. ..... 355/30
2008/0030704 A1* 2/2008 Novak et al. ..... 355/53
2008/0032066 A1* 2/2008 Stiblert et al. ..... 427/595
2008/0054745 A1* 3/2008 Sentmanat ..... 310/89
2008/0173200 A1* 7/2008 MacPherson et al. ..... 101/485
2008/0173814 A1* 7/2008 Watanabe et al. ..... 250/310
2008/0282663 A1* 11/2008 Dunning et al. ..... 56/344
2008/0282921 A1* 11/2008 MacPherson et al. ..... 101/485
2008/0299875 A1* 12/2008 Duescher ..... 451/56
2009/0031579 A1* 2/2009 Piatt et al. ..... 34/82
2009/0061331 A1* 3/2009 Nakano ..... 430/30
2009/0081374 A1* 3/2009 Yang et al. ..... 427/487
2009/0081827 A1* 3/2009 Yang et al. ..... 438/104
2009/0130607 A1* 5/2009 Slafer ..... 430/323
2009/0212213 A1* 8/2009 Nakasuji et al. ..... 250/310
2009/0226308 A1* 9/2009 Vandor ..... 415/178
2010/0003904 A1* 1/2010 Duescher ..... 451/259
2010/0038253 A1* 2/2010 Frodis et al. ..... 205/118
2010/0087695 A1* 4/2010 Cotter ..... 585/700
2010/0096550 A1* 4/2010 Yamazaki et al. ..... 250/310
2010/0110156 A1* 5/2010 Hara et al. ..... 347/102
2010/0152524 A1* 6/2010 Sentmanat ..... 600/16
2010/0216166 A1* 8/2010 Bonner et al. ..... 435/7.21
2010/0261159 A1* 10/2010 Hess et al. ..... 435/6
2011/0000182 A1* 1/2011 Lasker ..... 60/39.24
2011/0008613 A1* 1/2011 Takano et al. ..... 428/327

FOREIGN PATENT DOCUMENTS

DE 4110912 A1 * 10/1991
EP 230991 A2 * 8/1987
EP 324704 A1 * 7/1989
EP 696714 A1 * 2/1996
JP 54150774 A * 11/1979
JP 58017218 A * 2/1983
JP 63103907 A * 5/1988
JP 01076900 A * 3/1989
JP 02062421 A * 3/1990
JP 03108180 A * 5/1991
JP 03278812 A * 12/1991
JP 08169227 A * 7/1996
JP 09248414 A * 9/1997
JP 2004068825 A * 3/2004
JP 2006097530 A * 4/2006
JP 2008007380 A * 1/2008
WO WO 88/07103 9/1988

* cited by examiner

MICRO-STRUCTURED DRYING FOR INKJET PRINTERS

FIELD OF THE INVENTION

The present invention is related to the field of inkjet printers, and more particularly to the drying of the ink during the printing process.

BACKGROUND OF THE INVENTION

Inkjet printing is prominent because of its non-impact, low-noise characteristic, its use of plain paper, and its avoidance of toner transfers and fixing. Inkjet printing mechanisms can be categorized as either continuous or drop-on-demand. Drop-on-demand systems are generally lower cost but relatively low print speed when compared to continuous systems. In either drop-on-demand or continuous inkjet systems, it is necessary to assign a different fluid ink color to a separate printhead. Therefore, in color prints, several layers of wet ink may be deposited onto a printed medium.

Traditional printing presses are able to use high viscosity inks to obtain vibrant, high-density colors. However, continuous ink jet systems employ low viscosity solutions of dyes or pigments in a water solvent, and the printed colors tend to not be as vibrant and dense as with other printing systems. It is known that increasing the amount of dye or pigment applied to the paper can brighten the colors. However, this process also increases the amount water solvent applied to, and absorbed by, the paper. Absorption of water may cause a paper wrinkling effect called cockle, a wicking and spread of colors referred to as color-to-color bleed, and/or a show-through to the back side of the paper.

To remove water from the printed medium, continuous systems have conventionally utilized an end-of-line dryer that is similar to those used in printing presses. See for example U.S. Pat. No. 5,423,260 issued to Rockwell International Corporation in 1995, wherein the end-of-line dryer removes water from the printed medium only when all wet ink has been deposited and is at its maximum. It has been suggested to use infrared lamps or microwave radiation to preferentially heat the ink relative to the unprinted receiver media. However, tests have shown that dryers consisting of infrared lamps or microwave radiation cause a significant amount of receiver media heating to occur.

Further reductions in the time required between printing and drying have been realized by placing dryers between two printheads to dry the ink before significant amounts of the ink can wick into or otherwise be absorbed by the receiver media. Placement of dryers between printheads is referred to herein as "inter-station drying," and has been disclosed in U.S. Pat. No. 6,428,160B2, issued to Xerox in 2002. Inter-station drying is effective to provide better optical density, sharper edges, less show through and reduced cockle. In multi-color systems, high-speed dryers placed between the different color printheads reduce color-to-color bleed, and enable more ink to be employed without overly wetting the receiver media. U.S. Pat. No. 5,631,685 discusses these benefits in relationship to single color printers. JP07-314661 speaks of these benefits for a multi-color inkjet printer. U.S. Pat. No. 6,428,160B2 addresses the paper scorching issues by selectively heating only the ink and not the paper. However, selective heating of the ink may create a saturated boundary layer at the ink surface. That is, as heat is directed to the newly applied ink, water evaporates rapidly from the surface of the ink, forming a thin layer of saturated air just above the ink. Therefore, it has been found necessary to include a mechanism for removing the saturated air layer just above the ink spot.

It has been suggested to remove the saturated air layer using a combination of convection and radiation. U.S. Pat. No. 5,261,166 discloses a dryer comprising a plurality of infrared burner units with air floatation dryer elements between the infrared units. The air floatation elements mentioned in the patent are of the Coanda type. U.S. Pat. No. 6,412,190 also employs infrared burners in conjunction with air bars. U.S. Pat. No. 6,088,930 employs alternating infrared sources and blower units. Suction nozzles are located between the infrared sources and the blower units to remove air from the blower regions. This patent discloses the concept of reflectors being placed on the opposite side of the paper from the infrared sources to reflect the radiation back at the paper. WO 88/07103 describes a dryer unit in which the lamp used for generation of infrared radiations enclosed in a box with a reflector behind the lamp and an infrared transmitting window in front of the lamp. Air is directed through the box to cool the lamp, the reflector, and the inner surface of the window. This air exits the box by way of a Coanda slot that causes the air to be directed between the window and the paper. U.S. Pat. No. 5,092,059 describes a dryer unit in which an infrared source directs infrared at the paper through a Quartz window. Coanda slots located on two sides of infrared source cause air to flow between the window and the paper to remove moist air from this space. Commonly assigned U.S. Pat. No. 6,058,621 describes a dryer in which a plurality of radiant heating bars direct radiation at photosensitive paper. Reflectors are placed behind the infrared lamps. Air flows out between the reflectors, impinging on the paper.

Air bearing systems allow for contact-less support of a print media, especially web-like materials. This contact-less support is sometimes crucial to ensure that the web or print is not damaged. The air bearing condition is traditionally created by deflecting the trajectories of the air molecules immediately adjacent to the print media in a direction parallel to the movement of the printed medium. The parallel movement of the air molecules thus establishes a cushion of air providing support for the printed medium. For example, U.S. Pat. No. 3,324,570 issued in 1967 teaches a float dryer developed for fabrics. A more recent adaptation of the 1967 patent, U.S. Pat. No. 5,261,166 issued to WR Grace in 1993, used a combination infrared and air flotation dryer. WR Grace uses a combination of their HI-FLOAT® air bar in combination with an infrared gas burner, INFRAWAVE® by Maxon Corporation, to create a fast dryer that removes the saturated boundary layer by impinging air upon the ink surface. The end-line dryer taught by WR Grace requires that all fluid inks be placed onto the printed media web prior to initiation of drying.

The patents described above utilize infrared radiation to provide the energy transfer needed for effective drying combined with air bearing features to enhance the transfer of moist air away from the paper. None of the prior art used a microporous filter air bearing design, as is the case of the present invention, but rather used either Coanda type or air bar types of air bearings. While Coanda type or air bar types of air bearings are effective to handle large air volumes and velocities, the air flow is directed toward a common point, which causes a wet image to smear at the air impingement point. It would be advantageous to allow for a diffuse and more controlled overall air flow without loosing the capacity for large air flow or volume.

It is an object of the present invention to provide an inter-station drying system such that the benefit of rapid drying of printed ink or other water based liquid without the creation of a saturated boundary layer issue by supplying a large volume and high velocity air flow such that air flow prevents overheating without creating additional smear, and to rapidly cool the substrate by removing any residual heat generated by the radiation source.

It is another object of the present invention to provide a dryer system to be used in close proximity and in series with at least one inkjet printhead or water based liquid applicator to include a source of heat, a source of air flow, and a structure in communication with the air flow that converts the air flow to a substantially diffuse flow compatible with printed, wet inks. The diffuse flow of air is such as to create a cushion of air at the surface of the receiver medium.

It is still another object of the present invention to arrange air sources along the printed medium and on both sides of the receiver medium in a manner to provide a contact-less receiver medium support.

It is yet another object of the present invention to layer the heat source and the gas source to minimize the overall length of the printing system.

SUMMARY OF THE INVENTION

According to a feature of the present invention, a dryer operable in close proximity to and in series with a water based liquid applicator such as, for example, an inkjet printhead comprises a heat source and an air bearing structure on one side of the predetermined path and having a pressurized air inlet and an air outlet adjacent to the drying position of the receiver medium. Air flow from the air bearing structure outlet forms an air bearing for the receiver medium. A microporous filter is positioned at the outlet and is adapted to convert the air flow from the outlet to a diffuse flow, the microporous filter being formed of an inner layer of very fine screen for optimum air diffusion and an outer layer of courser woven screen to add rigidity and protection from scuffing.

According to a preferred feature of the present invention, the heat source is radiative and is adapted to selectively heat the water based liquid rather than the receiver medium. The microporous filter is a stainless steel laminate microstructure According to another preferred feature of the present invention a second air bearing structure is provided having an outlet adjacent to the drying position on a side of the predetermined path opposed to the one side, wherein positive pressure is applied onto a first side of the receiver medium by the first-mentioned air bearing structure and onto a second side of the receiver medium by the second air bearing structure to create a contact-less support for the receiver media.

According to yet another preferred feature of the present invention, the heat source is adapted to emit radiation on the one side of the predetermined path; the air bearing structures are transparent to the emitted radiation; and the second air bearing structure includes a reflector adapted to reflect radiation that has passed through the receiver medium back to the receiver medium. There may be a plurality of applicators along the predetermined path, and there is a drying position between each pair of the applicators.

According to still another preferred feature of the present invention, a receiver support drum is provided adjacent to the drying position on a side of the predetermined path opposed to the one side to support the receiver medium at the drying position.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
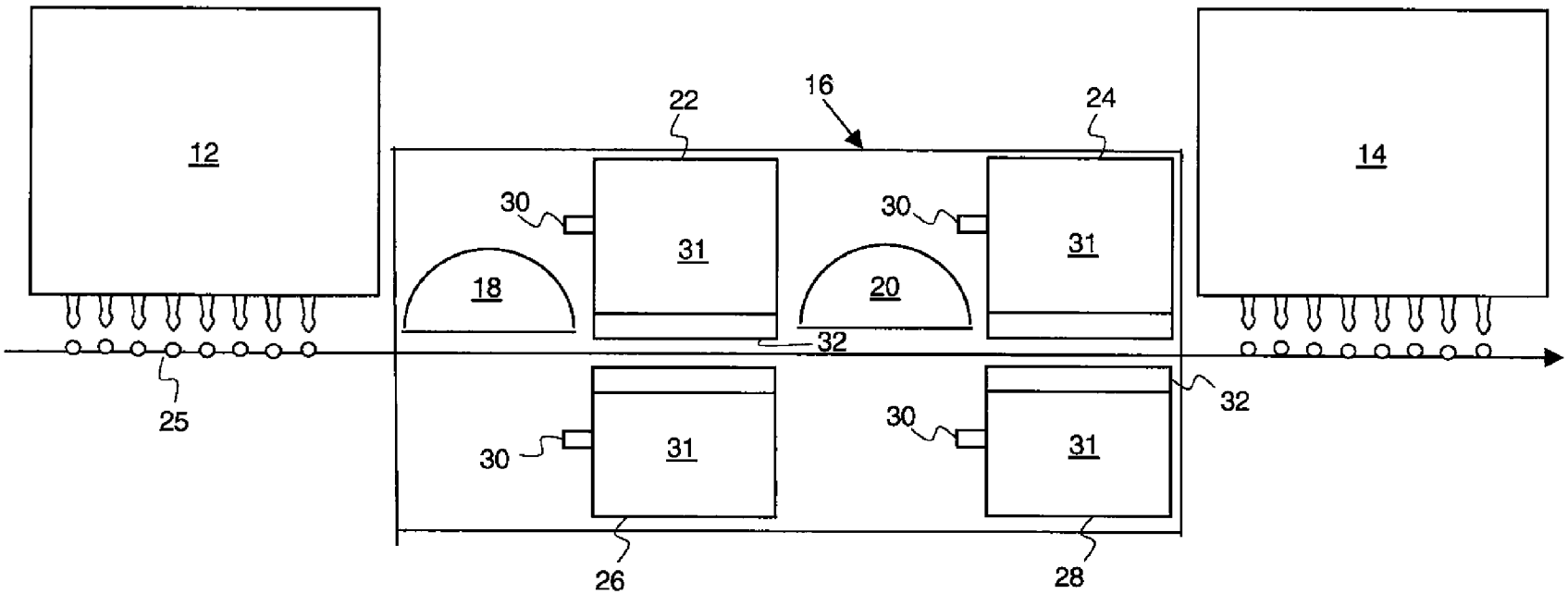
FIG. 1 is a schematic view of an inkjet printer system with an inter-station dryer system according to the present invention.

Referring now to FIG. 1, a first printhead 12 and a second printhead 14 are separated by an inter-station dryer 16. While the preferred applications of the present invention are for use in drying of inkjet inks on print media, the dryers could also be useful for drying other coatings on paper and other media. The dryer illustrated is a combination of radiation sources 18 and 20. Radiation sources 18 and 20 may be any source of radiation that selectively dries only the fluid ink without sufficiently increasing the temperature of a receiver medium 25, such as for example near infrared lamps, microwaves, infrared radiation, etc. The two radiation sources 18 and 20 are followed respectively by air bearing structures 22 and 24.

Air bearing structures 22 and 24 are opposed, respectively, by similar air bearing structures 26 and 28. Each air bearing structure 22, 24, 26 and 28 includes an air inlet 30, an air plenum 31, and a microporous filter 32. According to a feature of the present invention, it has been found that a material used to form pleated tubular filter elements as a sand filter for use in an oil and/or gas producing well, as disclosed in U.S. Pat. No. 5,411,084, is particularly suitable for use as micoporous filter 32. Such a material is commercially available from Purolator Facet, Inc. of Greensboro, N.C., USA, and is sold under the registered trademark "POROPLATE." While the POROPLATE material is a stainless steel material, similar microporous filters can be fabricated using other materials. More generally, microporous filter 32 has an inner layer of very fine screen for optimum air diffusion and an outer layer of courser woven screen to add rigidity and protection from scuffing.

Air passes through microporous filter 32 impacting the printed receiver medium 25. This air must then flow parallel to the print media 25 to exit the gap between the print media 25 and the microporous filter 32. The air flow produced in this manner is highly effective in removing the saturated boundary layer from the air adjacent to the print media 25. The microporous filter based air bearings provide exceptional benefit in drying over earlier Coanda or air bar types of air bearings. First, the microporous structure ensures uniform air flow across the width of the air bearing so that drying is more consistent across the width of the dryer. Second, the diffuse nature of the air flow as it passes through the microporous filter prevents the air flow from blowing the ink around on the print media as can happen with Coanda type or air bar types of air bearings. As a result the microstructures allow for a large volume and high velocity of air output onto the printed receiver medium to improve drying without adversely affecting the print quality.

While the illustrated embodiment demonstrates two stations of the combined radiation and air bearing dryer, it will be understood that one or more stations may be used, depending on the application involved. Additionally, while the illustrated embodiment illustrates the air bearing structures directly opposing on either side of the printed media, the opposing air bearing structures may be offset one from the other in order to obtain a similar air bearing condition.

Figure 2:
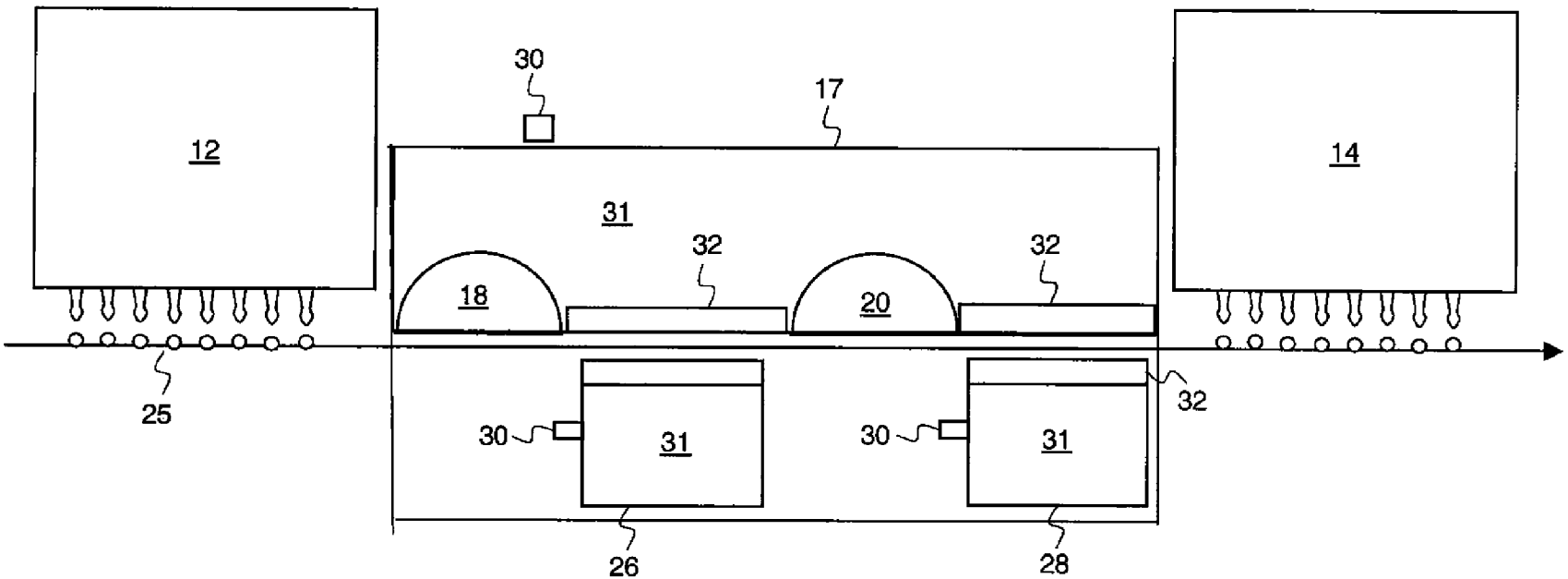
FIG. 2 is a schematic view of still another alternate embodiment of the present invention of FIG. 1.

FIG. 2 shows a second preferred embodiment of the present invention wherein the housing for interstation dryer 17, which holds radiation sources 18 and 20, also serves as a plenum to supply air to both of the microporous filter elements 32. In this way, the air supplied for the air bearing function can also serve to cool the reflectors of the radiation sources.

Figure 3:
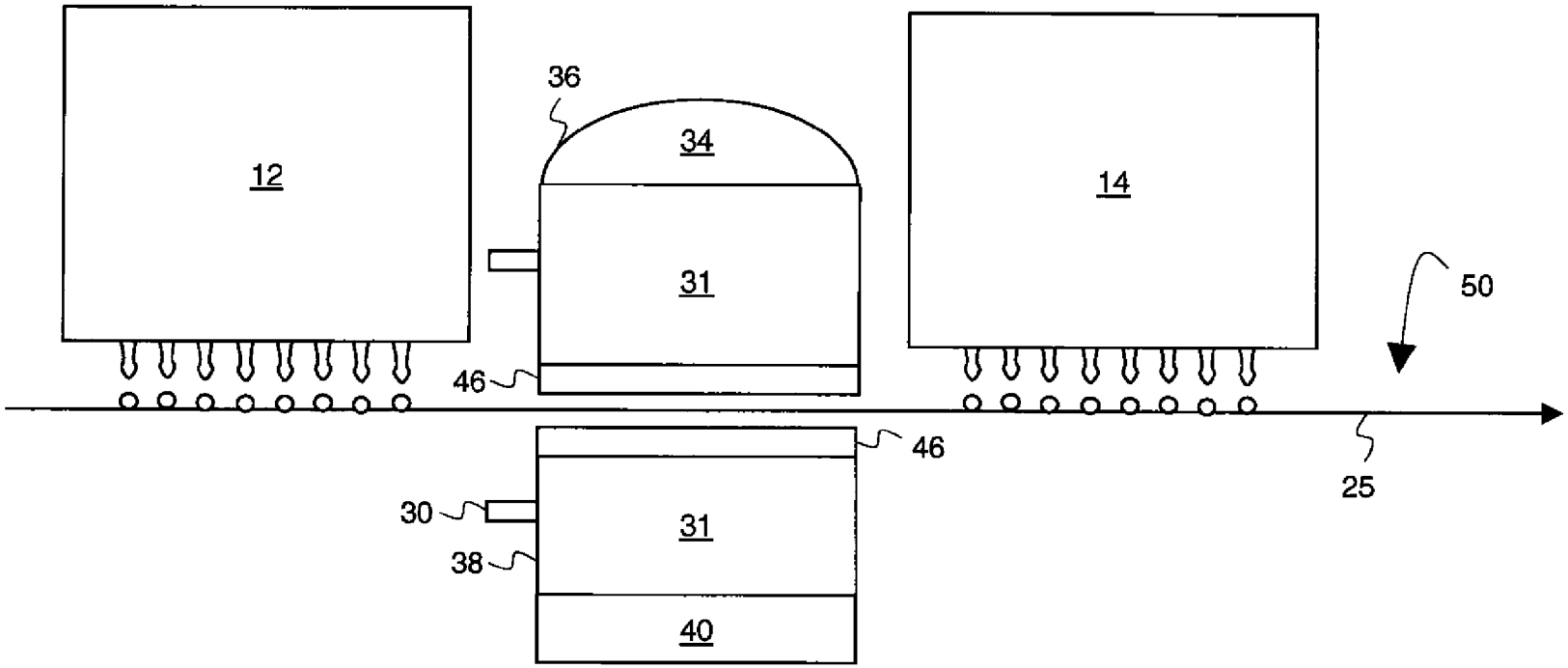
FIG. 3 is a schematic view of an alternate embodiment of the present invention showing a microstructured air bearing inter-station combination dryer.
Figure 4:
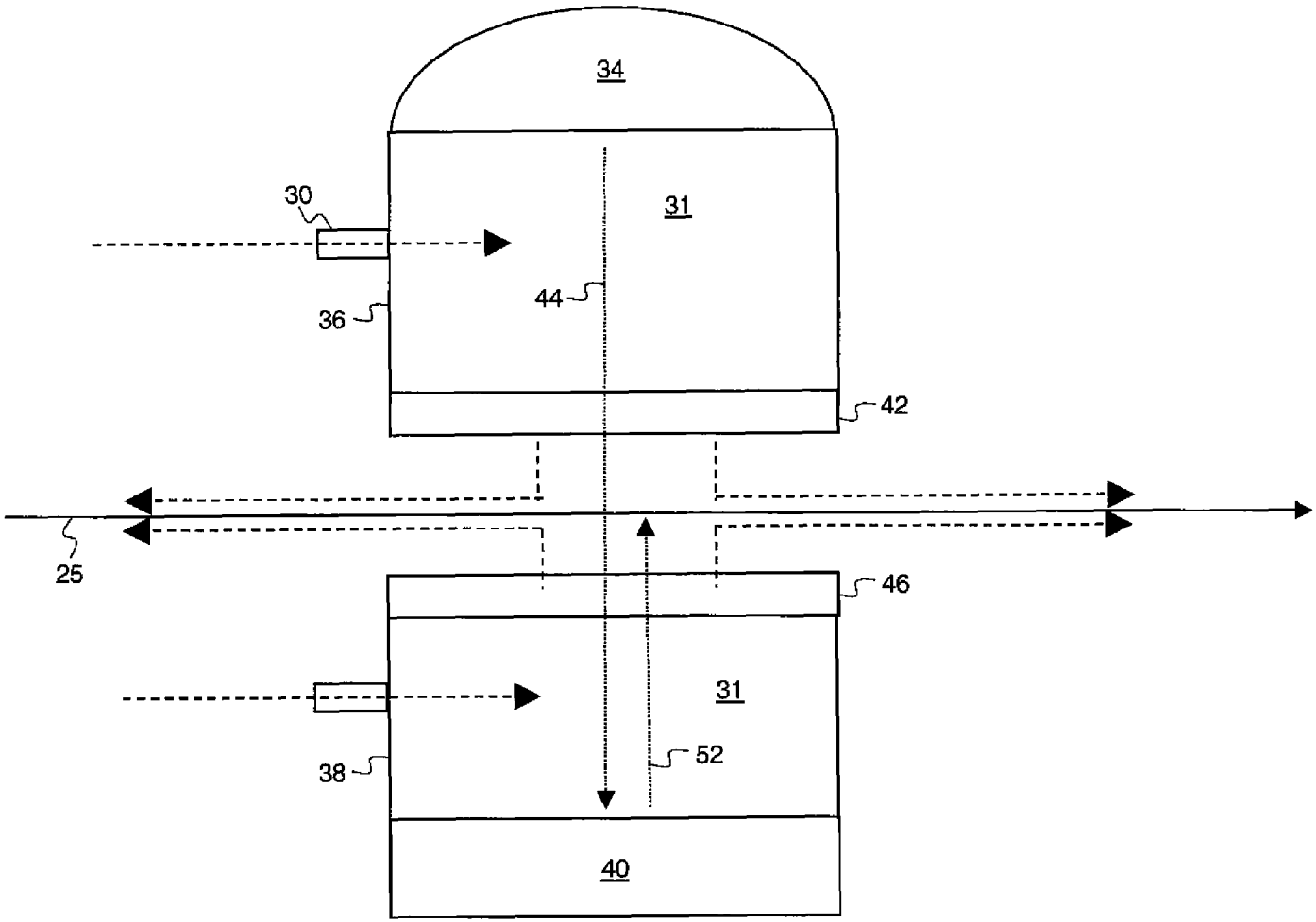
FIG. 4 is a detail view of the embodiment of FIG. 3.

In a third preferred embodiment of the present invention illustrated in FIGS. 3 and 4, the overall length of the inter-station dryer is further decreased. A radiation source 34 is incorporated into an air bearing structure 36. An infrared reflector 40 is integrated into air bearing structure 38. In FIG. 4, radiation from radiation source 34 moves along a path 44 through the plenum 31 and the microporous filter 42 of the air bearing structure 36 to receiver medium 25 to partially dry the fluid ink without sufficiently increasing the temperature of the receiver medium. Because standard materials for a printed web are transparent to infrared radiation, much of the radiation will transmit through the receiver medium, pass through second air bearing structure 38, plenum 31 and associated microporous filter 46 to be reflected back along a second path 52 to receiver medium 25 to complete the drying process of the fluid ink without sufficiently increasing the temperature of the receiver medium. This arrangement allows for the irradiation of both surfaces of wet ink on the printed web for a more complete and effective drying time. One skilled in the art will readily notice that microporous filters 42 of air bearing structures 36 and 38, respectively above and below the web, must be radiation transparent. This requires that microporous filters 42 be made out of a glass or polymer that is transparent to the radiation produced by radiation source 34. In this way, air can be directed at high volume and high velocity but in a diffuse manner at the web by microporous filter 42, the radiation can pass through it largely unaffected. In FIG. 4, dashed lines indicate the direction of air flow from air inlets 30 toward and along the receiver medium 25. Radiation follows large dotted lines 44 from radiation source 34 through microporous filters 42 to infrared reflector 40 and returns to receiver medium 25.

Figure 5:
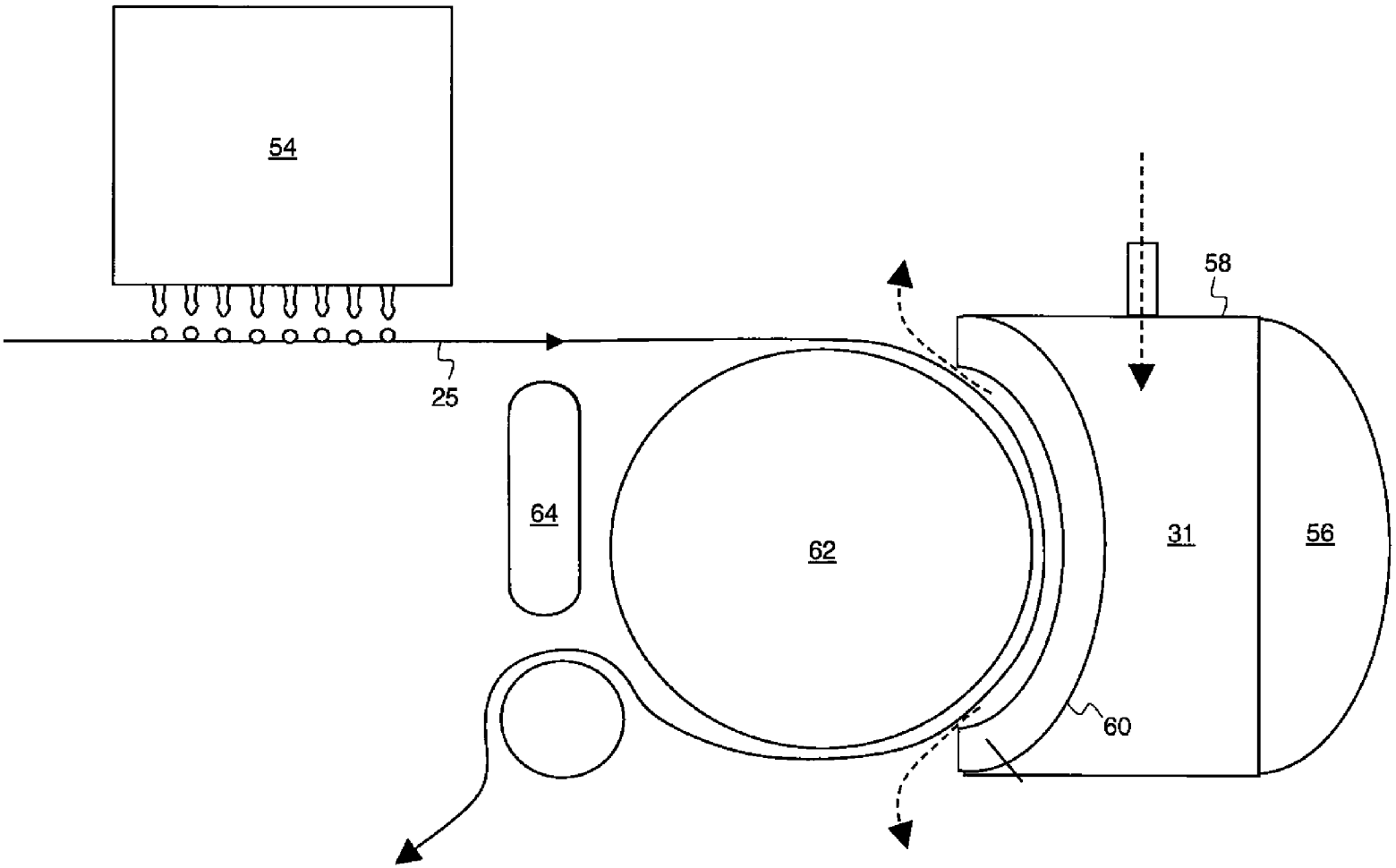
FIG. 5 illustrates still another embodiment of the present invention, specifically for drying around a drum.

In FIG. 5, a printhead 54 represents the final printhead of a series wherein inter-station dryers are positioned between the printheads. A radiation source 56 is integrated with an air bearing structure 58 having a microporous filter 60. A web support, such as a drum 62, consists of a radiation absorbing material. The presence of air in this embodiment is solely for removal of the saturated boundary layer since the receiver material is not supported on an air bearing. This embodiment allows for the radiation absorption by receiver medium 25 such that the bottom side of the receiver medium may be heated. The microporous filter 60 has been curved to match the curvature of drum 62 and to provide more efficient air transfer. However, the inventive contribution of the present invention is not limited to a curved structure, and may also include an array of small linear microstructures such that the desired area is covered. Likewise, while not necessary but included in the illustration as a preferred version of this embodiment, an optional radiation source 64 may be included on the side of drum 62 opposed the combined radiation and air source to increase the heating capacity of the drum and to allow the receiver medium to maintain a more constant temperature during slow print speeds. In another embodiment, one or more heater elements such as are described in U.S. Pat. No. 4,982,207, not shown, can be attached to the inside surface of the drum 62 to heat the drum. Such heaters would be used instead of the optional radiation source 64. By heating the print media by direct contact with the heated drum 62 in combination with the radiative heating of the ink by the radiation sources 56 and the air flow produced by the air bearing structure 58, these embodiments have enhanced drying capacity.

Figure 6:
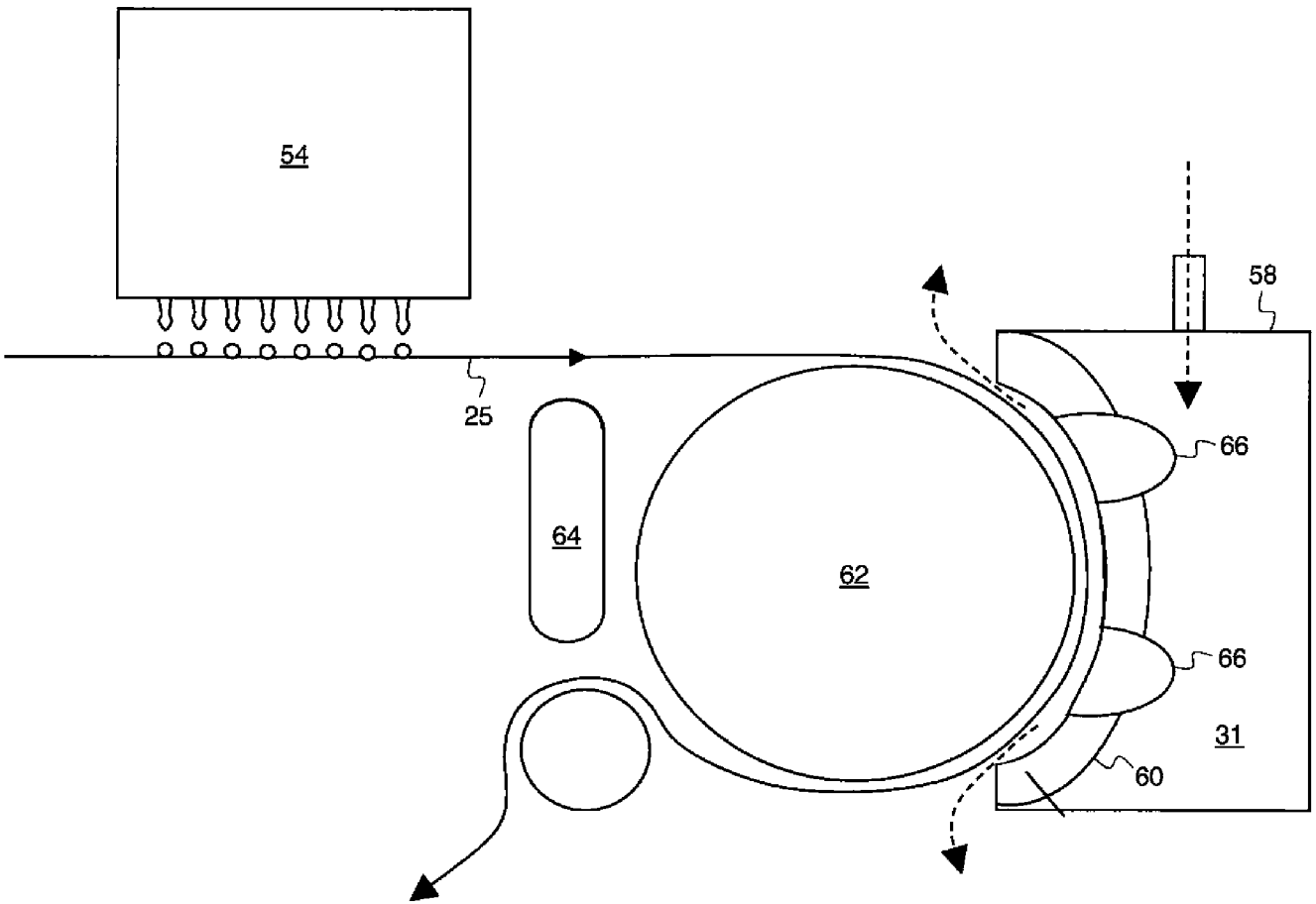
FIG. 6 is shows an embodiment of the present invention similar to that of FIG. 5.

Referring to another embodiment shown in FIG. 6, air is supplied through an air port, and distributed by plenum 31 of air bearing structure 58 to a plurality in microporous filter elements 60. Radiation sources 66 integrated into air bearing structure 58 direct near IR radiation at the printed media. As in FIG. 5, one or more heater elements such as are described in U.S. Pat. No. 4,982,207 can be attached to the inside surface of the drum 62 to heat the drum. Such heaters would be used instead of the optional radiation source 64.

The invention has been described in detail with particular reference to certain preferred embodiments thereof, but it will be understood that variations and modifications can be effected within the spirit and scope of the invention. For example, while a preferred application of the present invention is for use in drying of inkjet inks on print media, the dryers could also be useful for drying other coatings on paper and other media.

PARTS LIST

12. first printhead
14. second printhead
16. inter-station dryer
17 air bearing structure
18. radiation source
20. radiation source
22. air bearing structure
24. air bearing structure
25. print medium
26. air bearing structure
28. air bearing structure
30. air inlets
32. microporous filters
34. radiation source
36. air bearing structure
38. air bearing structure
40. infrared reflector
42. microporous filter
44. path
46. microporous filter
52. second path
54. printhead
56. radiation source
58. air bearing structure
60. microporous filter
62. drum
64. radiation source
66 radiation source

The invention claimed is:

1. A dryer operable in close proximity to and in series with an applicator for ejecting a water based liquid onto a receiver medium traveling along a predetermined path from the applicator to a drying position that is beyond the applicator; said dryer comprising:

a heat source; and an air bearing structure on one side of the predetermined path, the air bearing structure including a pressurized air inlet and an air outlet, the air outlet being located adjacent to the drying position of the receiver medium, wherein an air flow from the air outlet of the air bearing structure forms an air bearing that supports the receiver medium, the air outlet of the air bearing including a microporous filter that converts the air flow exiting the outlet to a diffuse flow, said microporous filter being formed of an inner layer of very fine screen for optimum air diffusion and an outer layer of courser woven screen.

2. A dryer as set forth in claim 1, wherein the heat source is radiative and is adapted to selectively heat the water based liquid rather than the receiver medium.

3. A dryer as set forth in claim 1 wherein the microporous filter is a laminate microstructure.

4. A dryer as set forth in claim 1 wherein the microporous filter is a stainless steel microstructure filter.

5. A dryer as set forth in claim 1 further comprising a second air bearing structure having an outlet adjacent to the drying position on a side of the predetermined path opposed to said one side, wherein positive pressure is applied onto a first side of the receiver medium by the first-mentioned air bearing structure and onto a second side of the receiver medium. by the second air bearing structure to create a contact-less support for the receiver media.

6. A dryer as set forth in claim 5 wherein:

the heat source is adapted to emit radiation on said one side of the predetermined path;

the air bearing structures are transparent to the emitted radiation; and the second air bearing structure includes a reflector adapted to reflect radiation that has passed through the receiver medium back to the receiver medium.

7. A dryer as set forth in claim 1 further comprising a receiver support drum adjacent to the drying position on a side of the predetermined path opposed to said one side to support the receiver medium at the drying position.

8. A dryer as set forth in claim 1 wherein there are a plurality of applicators along the predetermined path, and there is a drying position between each pair of said applicators.

9. A dryer as set forth in claim 1 wherein the applicator is an ink jet printhead and the water based liquid is ink.

10. A method of drying ink ejected from an inkjet printhead onto a print medium traveling along a predetermined path from the applicator to a drying position that is beyond the applicator; said method comprising the steps of:

providing heat to the receiver medium at the drying position;

forming a diffuse flow of air to create an air bearing that supports the receiver medium at the drying position by flowing air under pressure through a microporous filter located at an outlet of an air bearing structure that is positioned adjacent to the drying position, the microporous filter formed of an inner layer of very fine screen for optimum air diffusion and an outer layer of courser woven screen.

11. A method as set forth in claim 10 wherein the microporous filter is a laminate microstructure.

12. A method as set forth in claim 10 wherein the microporous filter is a stainless steel microporous filter.

13. A method as set forth in claim 10 wherein the microporous filter is transparent to radiant energy from the heat source.

14. A method as set forth in claim 10, further comprising:

creating an exit for the air flow by providing a gap between the receiver medium and the microporous filter.

15. A dryer as set forth in claim 1, wherein a gap exists between the receiver medium and the microporous filter that provides an exit for the air flow.

* * * * *